US005100338A

United States Patent [19]

Lu

[11] Patent Number: 5,100,338

[45] Date of Patent: Mar. 31, 1992

[54] CONTACT FOR CIRCUIT BOARD SOCKET

[75] Inventor: Sidney Lu, Sunnyvale, Calif.

[73] Assignee: Foxconn International, Inc., Sunnyvale, Calif.

[21] Appl. No.: 575,799

[22] Filed: Aug. 31, 1990

[51] Int. Cl.[5] ..... H01R 13/00

[52] U.S. Cl. ..... 439/326; 439/885

[58] Field of Search ..... 439/296, 325, 326, 328, 439/629–637, 885

[56] References Cited

U.S. PATENT DOCUMENTS

| | | | |
|---|---|---|---|
| 2,811,705 | 10/1957 | Schumacher | 439/885 |
| 4,136,917 | 1/1979 | Then et al. | 439/326 |
| 5,004,429 | 4/1991 | Yagi et al. | 439/326 |
| 5,009,611 | 4/1991 | Regnier | 439/326 |

*Primary Examiner*—Joseph H. McGlynn
*Attorney, Agent, or Firm*—John J. Leavitt

[57] ABSTRACT

A contact for circuit board socket includes a planar conductor having an elongated base with oppositely spaced ends. A fulcrum leg is formed on one end of the base and has a cut-out space extending from outermost edge to the inside middle portion of the base so as to make the fulcrum leg more flexible. A contact leg is formed on the other end of the base and has a cut-out space extending lengthwise thereof between first and second parallel and spaced apart planar beam sections. The end of the base sections remote from the base are joined and the cut-out space extends to the middle portion of the base but does not communicate with that of the fulcrum leg. The conductor furthermore provides a stop means at the side of the contact leg, which cooperates with a similar stop means at the outer portion of the fulcrum leg to form a pair of stop means. The pair of stop means function to protect the contact from excess deformation, and to provide a holding portion to cooperate with a specific tool when the contact is inserted into a socket by the tool.

16 Claims, 5 Drawing Sheets

CONTACT FOR CIRCUIT BOARD SOCKET

BACKGROUND OF THE INVENTION

1. Field of The Invention

The present invention relates to the contacts for a circuit board socket, and the invention is particularly concerned with the problem of obtaining adequate contact force between the contacts of a circuit board socket and the conductive contact areas of the circuit board, and constitutes an improvement of the structure disclosed in U.S. Pat. No. 4,832,617 assigned to the same assignee as the invention herein.

2. The Prior Art

U.S. Pat. No. 4,832,617 discloses a practical and beneficial improvement of a circuit board socket to prevent the latch means from breakage resulting from improper movement. Referring to FIG. 1, it will be seen that the contact of the patent consists of one contact leg and one fulcrum leg. Because the fulcrum leg lacks sufficient flexibility to cooperate with the contact leg to effect adequate engagement with the conductive area of the circuit board, sometimes an imperfect contact occurs between the contact of the socket and the conductive area of the circuit board.

To overcome the forgoing disadvantage of the prior art contacts, it is an object of the present invention to provide a contact which provides an improved conductive engagement between the socket contact and the conductive contact area of the circuit board.

Another object of the invention is to provide a contact by which the installation method can be altered from an upward direction to a downward direction without damaging the main body of the contact so that the recess of the socket can be reduced and the bottom surface of the contact will not be contaminated during soldering of the socket on the main board.

It is a further object of the present invention to provide a contact which forms a stop means on either side of the main body so that the contact will not be overstressed notwithstanding application of an improper insertion force.

A still further object of the present invention is to provide a contact which is easy to insert into the slot evenly and exactly.

Yet another object of the present invention is to provide a contact which, for different type sockets, may be conveniently modified by changing only the corresponding dies of the side parts, and not the corresponding dies of main parts, thus increasing its versatility in manufacturing to produce different type contacts for different type sockets, such as vertical type, slanted type, or horizontal type, etc.

A further object of the present invention is to provide a contact with which can be used various types of carrier strips stamped to form the contact.

It is a further object of the present invention to provide a contact which is easy to be applied to surface mount technology in soldering processes.

The invention possesses other objects and features of advantage, some of which with the foregoing, will be apparent from the description and drawings. It is to be understood however that the invention is not limited to the embodiment described and illustrated since it may be embodied in various forms within the scope of the appended claims.

SUMMARY OF THE INVENTION

The invention in terms of broad inclusion provides a contact comprising a planar conductor having an elongated base with spaced ends. A fulcrum leg is formed adjacent one end portion of the base and has a cut-out space extending from the outermost edge to the inside middle portion of the base so as to make the fulcrum leg more flexible. A contact leg is formed on the other end of the base and has a cut-out space extending between first and second parallel and spaced planar beam sections. The ends of the beam sections remote from the base are joined and the cut-out space extends to the middle portion of the base. The cut-out space of the fulcrum leg and that of the contact leg are separated by the base. A stop means is provided at the side of the contact leg, which cooperates with a similar stop means on the outer portion of the fulcrum leg to form a pair of stop means. This pair of stop means function to protect the contact from excessive deformation, also and acts as a holding portion to cooperate with a specific and appropriate tool when the contact is inserted into the socket by the tool. Accordingly, with this pair of stop means, in continuous stamping for the different type contacts applied in the different type sockets, it only requires a change of the corresponding folding dies of the side parts, and does not to require a change of the corresponding dies of the main parts. This increases the versatility of the manufacturing process. Also, this feature enables various types of carrier strips which are stamped to shape and form the contact thereof.

The invention, together with further objects and attendant advantages, will be best understood with reference to the following detail description taken in conjunction with the accompanying drawings.

DETAILED DESCRIPTION OF THE PREFERRED EMBODIMENT

Figure 1:
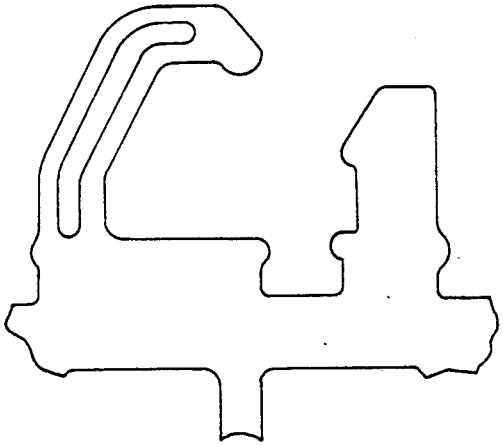
FIG. 1 PRIOR ART
FIG. 1 is an enlarged elevation of a prior art contact.
Figure 2:
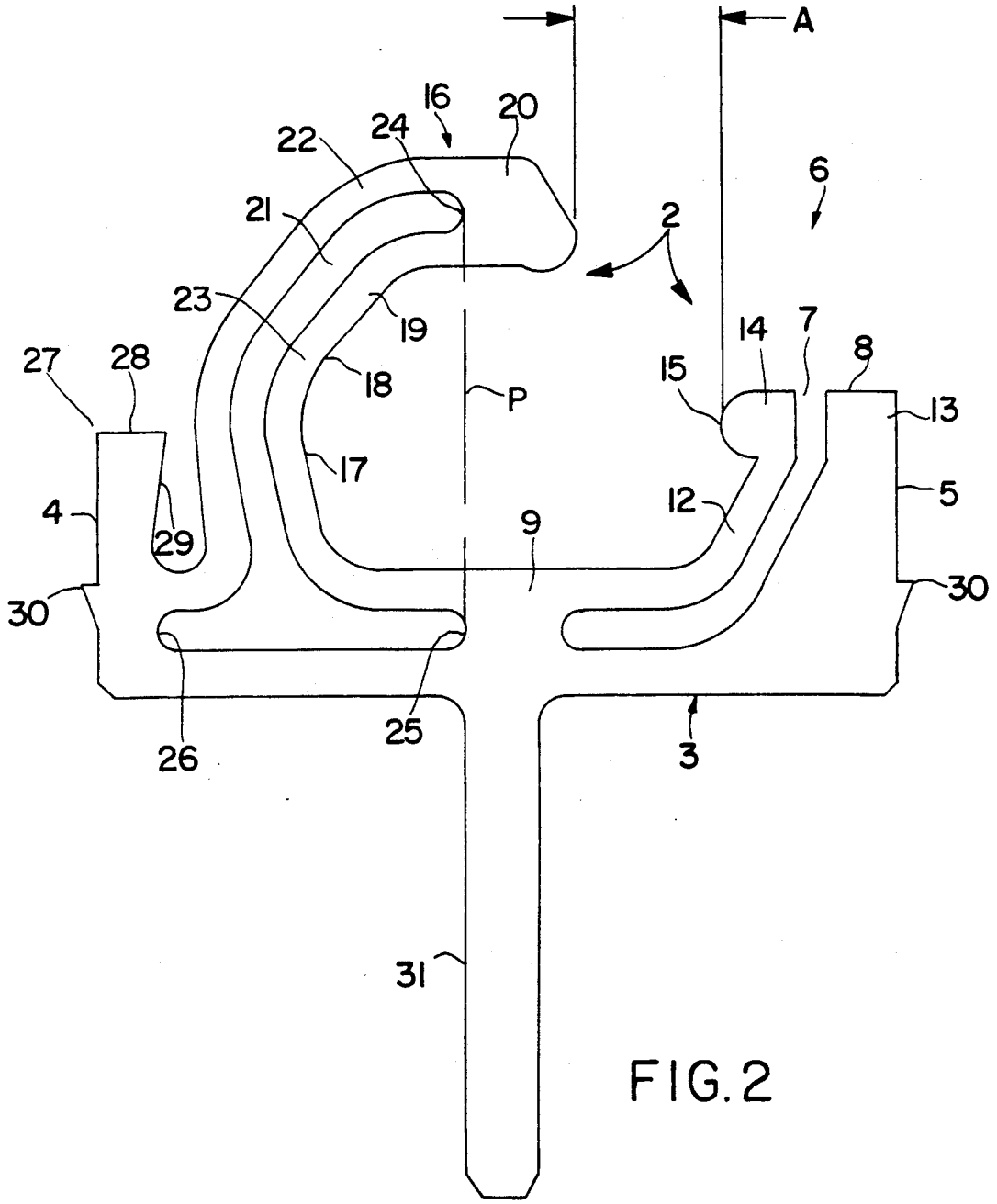
FIG. 2 is an enlarged elevation of the contact of the present invention.

In terms of greater details, and referring now to FIG. 2, the subject contact 2 includes a planar conductor having an elongated base 3 with two laterally spaced ends 4 and 5. A fulcrum leg 6 is formed on one end of the base 3 and has a cut-out space or slot 7 extending from the outermost horizontal edge 8 to the inside middle portion 9 of the base 3, thus dividing the fulcrum leg 6 into two bifurcated parts, namely, an inner portion 12 and an outer portion 13. The inner portion 12 of the fulcrum leg 6 extends up and away from the base 3 at a 120 degree angle with the horizontal, and the intersection part conforms to a 60 degree arc. The cut-out space or slot 7 is similar in configuration to inner portion 12 of the fulcrum leg 6 except that on the free end of the inner portion 12 there is provided a semi-circular projection 14 on which there is a fulcrum surface 15 adapted to engage with the conductive area of the board.

On the other end of the elongated base 3 there is a contact leg 16 shaped as three sectional interconnected arc portions as shown. The contact leg 16 extends up and away from the base 3, slightly outwardly in the first section 17, continuously to near the same height as the top edge 8 of the fulcrum leg 6. Then the leg bends inwardly at 18 in a range of from 50 to 60 degrees of arc till reaching four tenths (0.4) of its length inwardly in a portion 19 that extends in a horizontal direction toward the fulcrum leg 6, and extends horizontally in the third section 20. The distance A in the horizontal direction between the top of the contact leg 16 and that of the fulcrum leg 6 is engaged by the thickness of the inserted board.

A cut-out space or slot 21 is defined along the contact leg 16. Moreover, the cut-out space 21 extends into the base 3, and extends horizontally inwardly but does not communicate with the cut-out space 7 of the fulcrum leg 6. By cut-out space 21, the contact 16 is formed as two parallel and spaced apart planar beam sections 22 and 23, joined by the top end section 20, and the cut-out space 21 between the adjacent edges of the two beam sections has a width substantially the same as the width of the beam sections. The upper end 24 of the cut-out space 21 in the end section 20 of the contact leg 16 lies in the same vertical plane P as the innermost end 25 of the cut-out space 21 in the base 3.

Beyond the contact leg 16, the base 3 extends laterally outwardly for a distance to the end edge 4. The cut-out space 21 in the base 3 also extends laterally outwardly to an outermost end 26 cooperating with the innermost end portion 25 and cut-out space 21 to form a modified T-shaped slot to enhance the elasticity of the contact leg 16. A stop means 27 is positioned on the outermost end 4 of the base 3 beside the contact leg 16, and extends upwardly to an end surface 28 lying a little bit lower than the fulcrum leg 6 as shown. The inward edge surface 29 of the stop means 27 lies generally in alignment with the outermost end 26 of the cut-out space 21 in the base 3.

A pair of barbs 30 positioned on both end edges 4 and 5 close to the bottom of the base are positioned so that during insertion of the contact into the socket there is interference formed between the contact and the socket to prevent backward movement of the contact. A tail 3 is provided at the center of the bottom of the base to go through an appropriate hole in the main board (not shown) to facilitate soldering.

It will be appreciated that there is a significant improvement in spring character for the contact leg 16 and the fulcrum leg 6 because of the cut-out space 7 employed in the fulcrum leg 6 and the cut-out space 21 extending into the base 3, which is not disclosed in U.S. Pat. No. 4,832,617. The contact leg 16 provides a better elasticity also because there is a proper space between the contact leg 16 and the stop means 27 to allow the contact leg 16 to resiliently and elastically spring outwardly when a force is applied against its free end portion 20.

The stop means 27 functions to prevent the contact leg 16 from excessive non-elastic deformation due to over-stress resulting from improper insertion of the board. The same function is found in the fulcrum leg 6. By the cut-out space 7, the outer portion 13 of the fulcrum leg 6, divided from the inner portion 12 of the fulcrum leg 6, functions similarly to the stop means 27 to restrict the inner portion 12 of the fulcrum leg 6 from destructive deformation resulting from incorrect insertion of the board. It also allows a broader range of tolerance between the insertion board and the socket contact, a parameter not present in U.S. Pat. No. 4,832,617.

Some unexpected advantages due to the stop means 27 and the outer portion 13 of the fulcrum leg 6 are found. First, installation of the contact to the socket can be altered from an upward direction to a downward direction without damaging the main body of the contact leg 16 and the fulcrum leg 6 for the reason that the contact can be held by the stop means 27, and the outer portion 13 of the fulcrum leg 6 by a tool, and it is easy to insert the contact into the corresponding slot in the socket evenly. The previous type prior art contact does not provide the same facility because there is no proper portion of the contact by which it may be held without the risk of damaging the contact body during the insertion procedure of the contact body into the slot. That is the reason why the previous type prior art contact is always inserted into the socket upwardly from the bottom. As a consequence, to accommodate the previous type prior art contact, the socket must be formed with a full contact width passageway to let the contact go through upwardly, and because the excess recess (i.e.passageway) of this structure is exposed on the bottom surface of the socket, then it is easy to contaminate the bottom surface of the contact when soldering the contact accompanied with the socket on the main board, thus influencing the conductivity of the contact. By contrast, referring to the present invention, at the socket bottom all that is required is to provide a small hole to let the tail 31 of the contact 2 extend through instead of a recess of full width for the contact as in U.S. Pat. No. 4,832,617. This eliminates all possibility for the contact to be contaminated during soldering on the main board.

Second, for different type sockets such as vertical type, slanted type, or horizontal type, referring to folding dies, the corresponding dies of the main parts including the contact leg 16 and the inner portion 12 of the fulcrum leg 6, do not need changing. Only the corresponding dies of the stop means 27 and the outermost portion 13 of the fulcrum leg 6 need to be changed to accommodate the different type sockets, thus providing greater flexibility in the manufacturing procedures.

Third, the contact is more easily applied by surface mount technology in the soldering process than the previous prior art contact.

Figure 3:
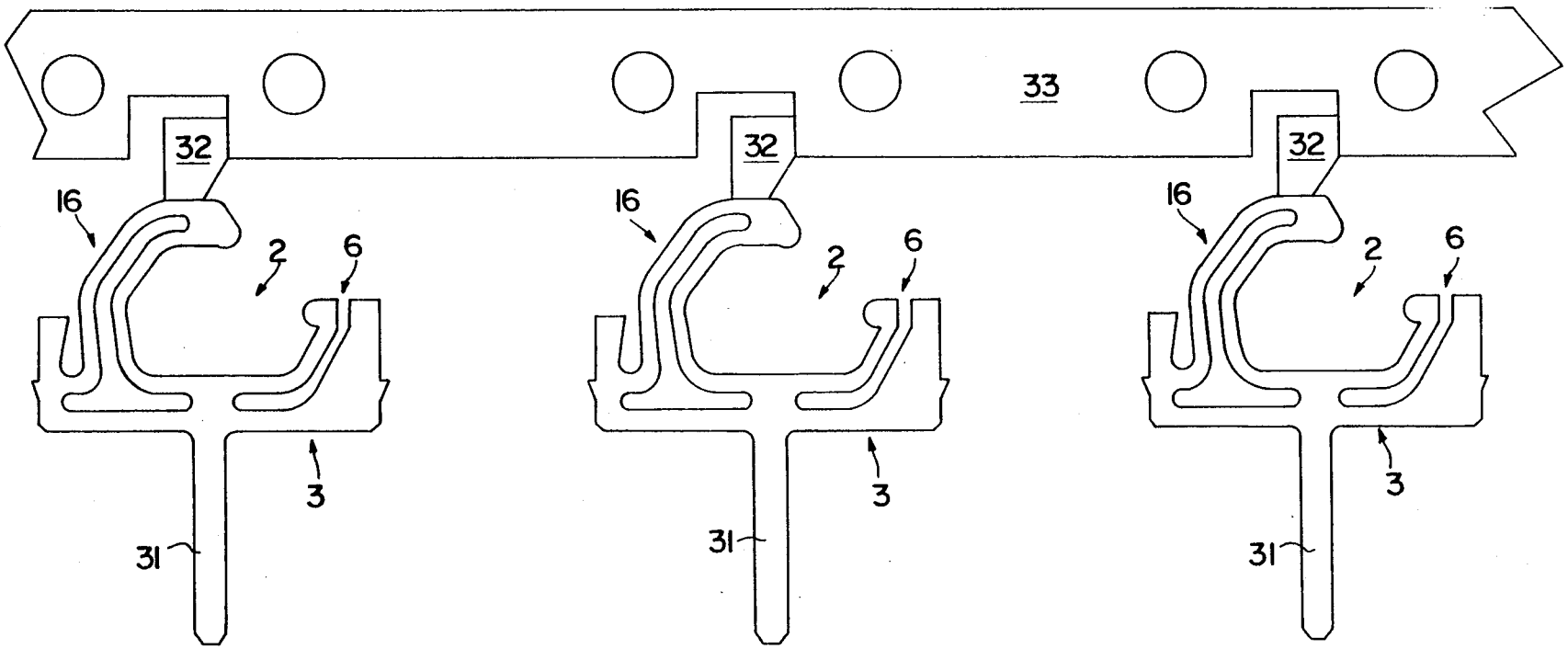
FIG. 3 is a fragmentary elevation of three stamped planar contacts on a common carrier strip.
Figure 4:
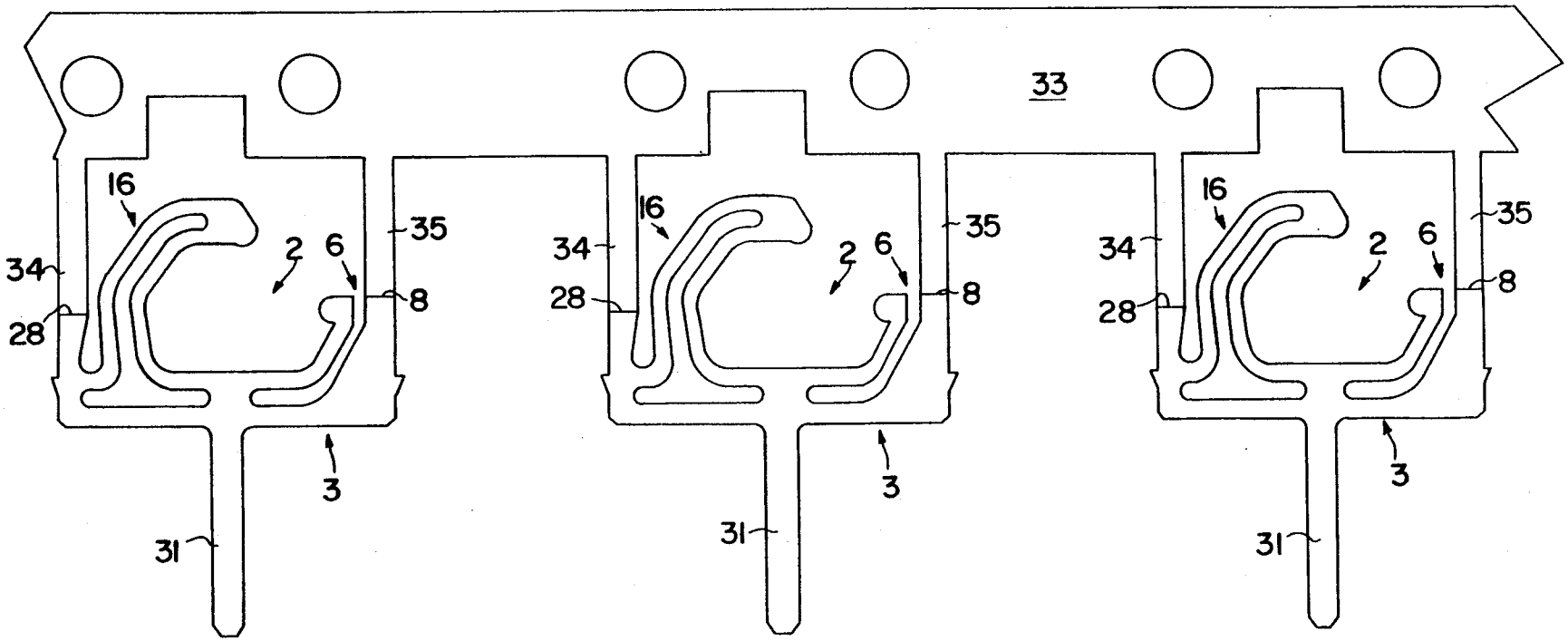
FIG. 4 is a fragmentary elevation of three stamped planar contacts on a different carrier strip.
Figure 5:
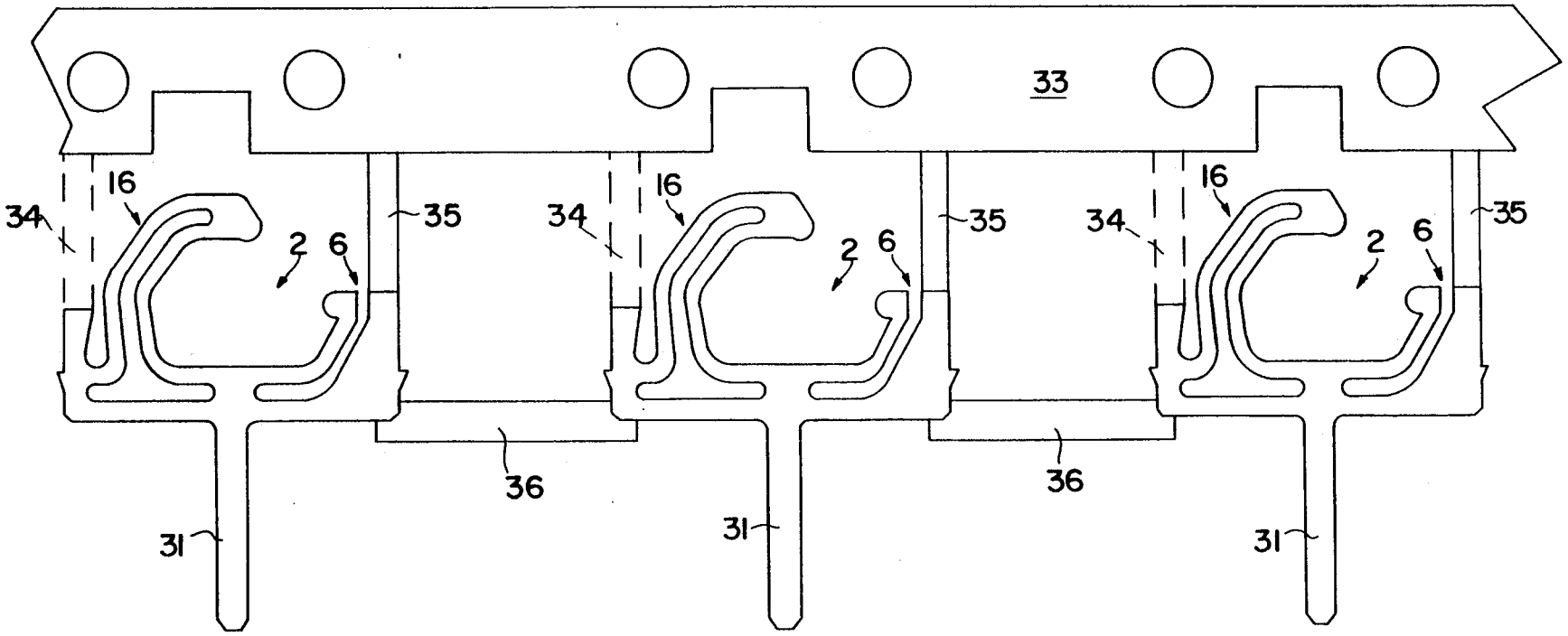
FIG. 5 is a fragmentary elevation of a third embodiment illustrating three stamped planar contacts on a different carrier strip.

The structure of the stop means 27 and the outer portion 13 of the fulcrum leg 6 also enable various efficient methods in manufacturing as shown in FIG. 3, 4 and 5. The connection portion 32 between the contact 2 and the carrier strip 33 can be at the top of the contact leg 16 as shown in FIG. 3. In FIG. 4, both the top 28 of the stop means 27 and the top 8 of the outer portion 13 are connected by straps 34 and 35, respectively, to the carrier strip 33. Another feasible way is to connect the carrier strip 33 and the contact 2 at either the top 8 of the portion 13, or the top 28 of the stop means 27 as shown in broken lines in FIG. 5. In this embodiment an auxiliary horizontal connection strip 36 is provided between the outer portion 13 and the stop means 27 to strengthen the whole structure of the carrier strip and contacts as shown in FIG. 5. It should also be noted that the auxiliary horizontal connection strip 36 can be replaced by the tails 31 extending from the base 3 connected to another opposite carrier strip (not shown). It should be understood that the various types of the carrier strips illustrated and described above can be modified to form other types to accommodate variations in the production line.

In conclusion, the details of the present invention provide an improved structure for a contact with specific reference to U.S. Pat. No. 4,832,617. While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims.

What is claimed is:

1. A contact for a circuit board socket comprising:

a planar conductor including an elongated base having spaced ends;

a fulcrum leg formed on and extending outwardly from one end of the base, and having a cut-out space extending from its outermost edge to the inside middle portion of the base so as to make the fulcrum leg more flexible;

a contact leg formed on and extending outwardly from the other end of the base, and having first and second parallel and spaced beam sections, a cut-out space extending between said first and second parallel and spaced apart planar beam sections, the ends of the beam sections remote from the base being joined and the cutout space extending to the middle portion of the base but not communicating with the cut-out space of the fulcrum leg.

2. The contact as described in claim 1, wherein a tail extends from the center of the bottom surface of the base to go through the main board for soldering.

3. The contact as described in claim 1 wherein a pair of barbs are provided projecting from said lateral]y spaced ends close to the bottom of the base.

4. The contact as described in claim 1, wherein the inner side of said fulcrum leg extends up at a 120 degree angle from the base, and the intersection portion constitutes a 120 degree arc.

5. The contact as described in claim 4, wherein said cut-out space in the fulcrum leg is similar in configuration to the inner portion of the fulcrum leg, and the fulcrum leg is configured to provide a semi-circular projection on the free end on which there is a fulcrum surface adapted to be engaged with the conductive area of the board.

6. The contact as described in claim 5, wherein said cut-out space divides the fulcrum leg into two spaced parts of which one is the inner portion and the other is the outer portion.

7. The contact as described in claim 1, wherein said contact leg is shaped as three interconnected sectional arc portions which extend up and away from the base slightly outwardly in the first section to near the same height as the top of the fulcrum leg, then bends inwardly in a range of from 50 to 60 degrees till reaching near four/tenths of its length in an inwardly horizontal direction in the second section, and extends horizontally in the third section.

8. The contact as described in claim 7, wherein said cut-out space of the contact leg between the adjacent edges of the two beam sections has a width substantially the same as the width of the beam sections.

9. The contact as described in claim 8, the end of said cut-out space of the contact leg lies same vertical plane as the innermost end of said cut-out space in the base.

10. The contact as described in claim 1 wherein the base extends laterally outwardly for a distance beyond said contact leg, and said cut-out space in the base also extends laterally outwardly to an outermost end to enhance the elasticity of the contact leg.

11. The contact as described in claim 10, wherein a stop means is positioned at the outermost end of the base beside the contact leg, and extends up to just below the upper end of the fulcrum leg, the inward edge surface of said stop means lying generally in alignment with the outermost end of the cut-out space of the contact leg in the base.

12. A contact for a circuit board socket adapted to be inserted into the socket from above the socket by an appropriate tool, comprising a base having opposite end portions; a contact leg and a fulcrum leg extending integrally from the base; and a pair of stop means formed on said opposite end portions of the base and extending from the base in the same direction as said contact leg and said fulcrum leg and in the same plane therewith whereby destructive flexure of said contact leg and fulcrum leg is prevented by said stop means, said pair of stop means functioning also as a holding portion to cooperate with the appropriate tool when the contact is inserted into the socket from above by said tool.

13. In combination, the contact described in claim 12, and a carrier strip connected to said contact wherein the connection of the carrier strip and the contact occurs at the top of the contact leg.

14. In combination, the contact as described in claim 12, and a carrier strip connected to said contact wherein the connection of the carrier strip and the contact occurs at the top of one or more of said stop means.

15. In combination, a plurality of contacts as described in claim 12, and a carrier strip connected to said contacts, wherein an auxiliary horizontal connection strip is provided connecting adjacent stop means of adjacent contacts.

16. The contact as described in claim 12, wherein the contact leg and the fulcrum leg can be elastically flexed through a range of angles in relation to said stop means in order to accommodate the different angle sockets.

* * * * *